US005385622A

United States Patent [19]

Klingebiel

[11] Patent Number: 5,385,622

[45] Date of Patent: Jan. 31, 1995

[54] WEB SPLICING METHOD AND APPARATUS

[75] Inventor: Karl-Heinz Klingebiel, Winsen/L, Germany

[73] Assignee: Körber AG, Hamburg, Germany

[21] Appl. No.: 184,238

[22] Filed: Jan. 19, 1994

[30] Foreign Application Priority Data

Feb. 4, 1993 [DE] Germany ..... 4303171

[51] Int. Cl.[6] ..... B65H 21/00

[52] U.S. Cl. ..... 156/157; 156/361; 156/504; 156/505; 156/541

[58] Field of Search ..... 156/157, 361, 504, 505, 156/541; 242/58.5

[56] References Cited

U.S. PATENT DOCUMENTS

| | | | |
|---|---|---|---|
| 2,377,971 | 6/1945 | Roesen | 242/58.5 |
| 4,157,934 | 6/1979 | Ryan et al. | 156/505 X |
| 4,290,834 | 9/1981 | Buettel | 156/504 X |
| 4,371,418 | 2/1983 | Krywiczanin et al. | 156/504 X |
| 4,379,012 | 4/1983 | Heymanns | 156/504 X |
| 4,840,694 | 6/1989 | Brookman et al. | 156/157 X |

*Primary Examiner*—Mark Osele
*Attorney, Agent, or Firm*—Darby & Darby

[57] ABSTRACT

The leader of a fresh flexible web of paper or the like is spliced to the trailing end of an expiring web by a row of uniting bands having coats of adhesive at both sides. Successive uniting bands of the row are peeled off a flexible carrier strip while being attached to one side of the leader. The expiring web is thereupon arrested and its trailing end is pressed against the uniting bands which already adhere to the leader of the fresh web. The peeling of uniting bands off the carrier strip takes place between a supply reel which stores convolutions of the carrier strip with a file of uniting bands on it, and a takeup reel for that portion of the carrier strip has been relieved of uniting bands. The number of uniting bands in a row depends upon the width of the fresh web and/or the expiring web. A carriage is movable back and forth transversely of the leader of the fresh web and carries an idler roller serving to peel a selected number of uniting bands off the carrier strip between the two reels.

12 Claims, 2 Drawing Sheets

WEB SPLICING METHOD AND APPARATUS

BACKGROUND OF THE INVENTION

The present invention relates to improvements in methods of and in apparatus for splicing webs of flexible material. More particularly, the invention relates to improvements in methods of and in apparatus for attaching leaders of fresh webs (which are stored in the form of rolls surrounding the cores of bobbins, reels or like devices) to selected portions (e.g., to trailing ends) of expiring webs, namely webs which are being drawn off cores of bobbins, reels or like storing devices. Typical examples of splicing apparatus which can embody the present invention are those used in the tobacco processing industries, e.g., to splice together webs of cigarette paper, wrapping material for arrays of cigarettes or other rod-shaped articles in packing machines of the tobacco processing industry, webs of artificial cork or like flexible material which is used to be draped around rod-like fillers of filter material for tobacco smoke in filter rod making machines, webs of uniting band material which are used to connect rod-shaped tobacco-containing articles with rod-shaped mouthpieces of filter material in filter tipping machines and/or others. However, the improved splicing method and apparatus can also be utilized in other branches of the industry, particularly where an expiring web or strip of paper, plastic or other flexible material is to be joined with a fresh web in a manner to avoid lengthy stoppages of individual machines or production lines.

It is well known to utilize strips of flexible material, which is coated with an adhesive at both sides, as a means for attaching the leader of a fresh web to the trailing end of an expiring web. The strip is placed between the leader and the trailing end and the leader is thereupon pressed toward the trailing end and/or vice versa to ensure the establishment of a reliable bond between the uniting band and the leader on the one hand and between the uniting band and the trailing end on the other hand. Problems arise when the webs which are to be spliced together are relatively wide, i.e., when one must employ relatively wide strips in order to ensure that the trailing end of an expiring web is reliably bonded to the leader of a fresh web all the way from the one to the other marginal portion. Such relatively wide strips of flexible material, both sides of which are coated with an adhesive, are expensive and hard to handle, especially if the splicing operation is to be completed within a short interval of time, e.g., in a fully automatic way.

OBJECTS OF THE INVENTION

An object of the invention is to provide a novel and improved method of splicing together webs of flexible material, such as paper, artificial cork, plastic foil or the like, with an adhesive substance which is applied to both sides of a strip of flexible material.

Another object of the invention is to provide a method which renders it possible to establish a reliable bond even if the width of the adhesive-coated strip is less, and even considerably less, than the width of the webs.

A further object of the invention is to provide a method which can be relied upon to splice together wide, narrow or medium wide webs of paper or the like with one and the same strip of adhesive-coated material, i.e., a strip whose width need not be changed or which need not be replaced with a wider or narrower strip just because the width of webs which are to be spliced together is more or less than the width of previously spliced-together webs.

An additional object of the invention is to provide a novel and improved method of manipulating uniting bands which carry adhesive coats at both sides and are to be employed for splicing together webs of paper, plastic foil or the like.

Still another object of the invention is to provide a novel and improved method of splicing together webs which are utilized in the tobacco processing industries.

A further object of the invention is to provide a novel and improved splicing apparatus which can be utilized for the practice of the above outlined method.

Another object of the invention is to provide the apparatus with novel and improved means for manipulating splicing material for webs of cigarette paper, other types of paper, plastic foils and the like.

An additional object of the invention is to provide a splicing apparatus which can be utilized as a superior substitute for conventional splicing apparatus in existing production lines, in discrete machines or elsewhere.

Still another object of the invention is to provide a versatile apparatus which can be set up to splice together wide, medium wide or narrow webs of flexible material.

A further object of the invention is to provide the above outlined apparatus with novel and improved means for storing an adhesive substance which is to be applied to webs of paper or the like in order to establish a reliable splice capable of withstanding requisite tensional stresses.

Another object of the invention is to provide a machine or a production line which embodies the above outlined splicing apparatus.

SUMMARY OF THE INVENTION

One feature of the present invention resides in the provision of a method of splicing a leader of a fresh web of paper, plastic or other flexible material to a selected portion of an expiring web of flexible material which may but need not be the same as the material of the fresh web. The improved method comprises the steps of applying an adhesive substance to one side of the leader of the fresh web, and pressing the applied adhesive substance at the one side of the leader of the fresh web and one side of the selected portion of the expiring web against each other.

The method preferably further comprises the steps of advancing the expiring web lengthwise along a predetermined path and maintaining the fresh web at a standstill in the course of the applying seep, advancing the leader and the adhesive substance thereon along a portion of the predetermined path and arresting the expiring web subsequent to the applying step, and maintaining the two webs at a standstill in the course of the pressing step. The applying step of such method preferably includes attaching a series of uniting bands which have adhesive first and second sides to a carrier so that one side of each uniting band adheres to but is separable from the carrier, contacting the one side of the leader of the fresh web with the other sides of a selected number of uniting bands of the series, and detaching the one side of each uniting band of the selected number of uniting bands from the carrier. The detaching step is preferably carried out simultaneously with the contacting step, and the contacting step can include applying the uniting bands of the selected number of uniting bands transversely of the leader of the fresh web.

The carrier can include or constitute an elongated strip of paper or other flexible material, and the contacting step can include moving the strip transversely of the leader of the fresh web.

The detaching step is or can be carried out simultaneously with the applying step, and the applying step can include individually biasing successive uniting bands of the selected number of uniting bands against the one side of the leader of the fresh web.

The detaching step can include peeling successive uniting bands of the selected number of uniting bands off the carrier, and the applying step of such method can include individually biasing successive uniting bands of the selected number of uniting bands against the one side of the leader of the fresh web in the course of the peeling step.

Another feature of the present invention resides in the provision of an apparatus for splicing a leader of a fresh web of paper or other flexible material to a selected portion of an expiring web of plastic or other flexible material with an adhesive substance. The improved apparatus comprises means for advancing the expiring web along a predetermined path, means for locating the leader of the fresh web adjacent a predetermined portion of the path, means for applying adhesive substance to one side of the leader of the fresh web, and means for pressing the applied adhesive substance and one side of the selected portion of the expiring web against each other. The apparatus preferably further includes a source of a flexible strip-shaped carrier of adhesive substance, and the applying means of such apparatus can comprise or form part of means for transferring adhesive substance from the carrier onto the one side of the leader of the fresh web. The source can comprise a supply reel and a takeup reel for the carrier, and the adhesive substance can include a series of discrete uniting bands having adhesive first sides separably adhering to one side of the carrier and adhesive second sides adhering to the one side of the leader of the fresh web under the action of the transferring means. The transferring means preferably includes a carriage and means for moving the carriage transversely of the leader of the fresh web adjacent the locating means. The moving means of such apparatus can include means for moving the carriage back and forth along a straight second path, and the carriage can include means for guiding a portion of the carrier along the transferring means. The transferring means can include an idler roller or another rotary member mounted on the carriage and engaging the other side of the carrier between the two reels.

The improved apparatus can further comprise means for selecting the extent of movability of the carriage along the second path, i.e., transversely of the predetermined portion of the path for the expiring web. The selecting means can include an adjustable stop for the carriage. The stop is adjustable in dependency upon (i.e., as a function of) the width of the fresh web which may but need not always be the same as that of the expiring web.

The reels of the source are rotatable in directions to draw the carrier off the supply reel and to collect the carrier on the takeup reel. The apparatus embodying such source of adhesive substance can further comprise means for arresting the takeup reel when a foremost uniting band of the series of uniting bands assumes a predetermined position relative to the carriage while the carriage is being maintained in a starting position at one side of the predetermined path. The arresting means can include means for monitoring the one side of the carrier between the two reels.

The transferring means can further comprise a back support for the other side of the leader of the fresh web opposite the second path, i.e., the support can extend transversely of the leader of the fresh web and transversely of the predetermined portion of the predetermined path.

The novel features which are considered as characteristic of the invention are set forth in particular in the appended claims. The improved splicing apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF THE PREFERRED EMBODIMENTS

Figure 1:
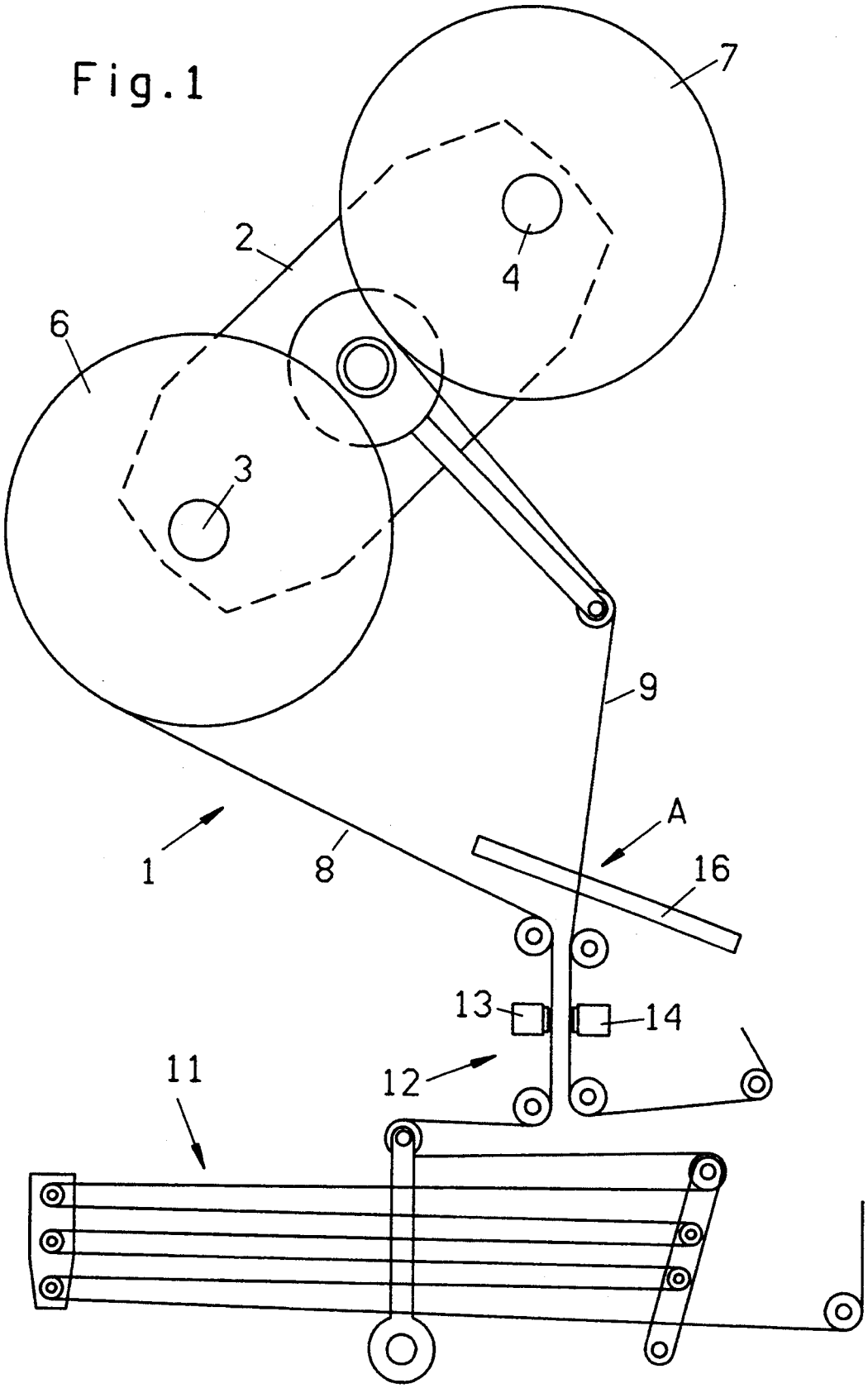
FIG. 1 is a schematic elevational view of certain constituents of a machine wherein the trailing portion of an expiring web is being spliced to the leader of a fresh web with an apparatus which embodies one form of the invention.

Referring first to FIG. 1, there is shown a bobbin changer 1 which can be utilized, for example, in a cigarette making, filter rod making or cigarette packing machine to continuously supply an expiring flexible web 8 of wrapping material (e.g., paper) to a web processing station, not shown. For example, the web 8 can be subdivided into blanks to form packets for arrays of twenty cigarettes each in a packing machine. Alternatively, the web 8 can be draped around a continuous filler of tobacco or filter material for tobacco smoke to form with the filler a continuous cigarette rod or filter rod which is to be subdivided into sections of unit length or multiple unit lengths. Such sections can be supplied to a filter tipping machine wherein sections of the tobacco rod (e.g., cigarettes of unit length) are united with filter rod sections of unit length or multiple unit length to form filter cigarettes of unit length or multiple unit length.

The bobbin 6 for the expiring web 8 is mounted on a support 2 in the form of a two-armed lever which is pivotable back and forth through an angle of at least 180° so as to cause the bobbin 6 to change places with a second bobbin 7 carrying a supply of fresh web 9. The bobbins 6, 7 are respectively rotatable with or relative to parallel shafts 3, 4 which are carried by the lever 2.

When the machine or production line which converts the expiring web 8 into a continuous tubular envelope or into a succession of blanks for use in a packing machine or the like is in actual use, the leader of the web 8 is drawn off the bobbin 6 in a downward direction, as viewed in FIG. 1, for example, by one of a number of pulleys forming part of a magazine 11 for a supply of expiring web 8. Such magazine is customary in many types of machines wherein a web is to be continuously supplied to a wrapping, severing or other unit.

On its way from the bobbin 6 to the magazine 11, the expiring web 8 advances through a normally inactive splicing apparatus 12 which is constructed and assembled in accordance with a presently preferred embodiment of the invention. The leader of the fresh web 9 is maintained in a position adjacent a selected portion of the path for the expiring web 8 from the bobbin 6 toward the magazine 11. The apparatus 12 comprises two pressing members 13, 14 which are disposed opposite the adjacent paths for the webs 8, 9 and at least one of which can be moved toward the other to thereby ensure proper attachment of the trailing portion of the expiring web 8 to the leader of the fresh web 9.

Figure 2:
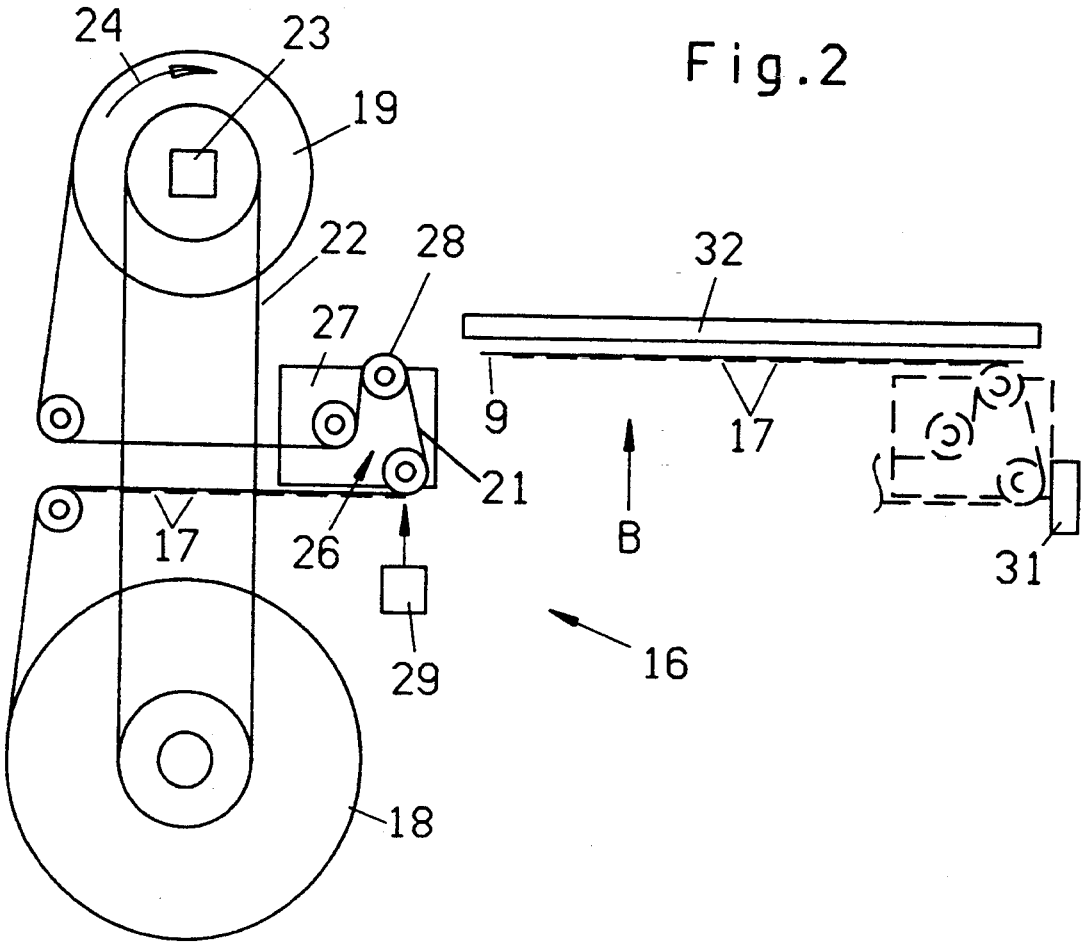
FIG. 2 is an enlarged elevational view of the splicing apparatus as seen in the direction of arrow A in FIG. 1.

The splicing apparatus 12 includes an assembly 16 the details of which are shown in FIG. 2 and which serves to apply an adhesive substance to one side of the leader of the fresh web 9 before the leader is pressed toward the trailing portion of the web 8 and/or vice versa, i.e., the assembly 16 is located ahead of the station for the pressing members 13 and 14. The adhesive substance is a film of hot melt or another suitable adhesive which is applied to both sides of each of a series of relatively small flexible uniting bands 17 (see also FIG. 3) which adhere to one side of a flexible carrier strip 21 of paper or other suitable material. A source of carrier strip 21 and of an elongated row of uniting bands 17 at one side of the carrier strip includes a supply reel 18 and a takeup reel 19. The means for rotating the takeup reel 19 in or counter to the direction indicated by an arrow 24 includes a prime mover (shown schematically in FIG. 2, as at 23) and a belt transmission 22 which rotates the supply reel 18 in response to rotation of the takeup reel 19 unless the lower pulley for the transmission 22 is uncoupled from the hub of the supply reel 18.

FIG. 2 further shows a set of pulleys or sheaves which serve to guide successive increments of the carrier strip 21 on their way from the supply reel 18 toward the takeup reel 19. Some of the pulleys for the carrier strip 21 are mounted on a carriage 27 (as shown at 26) to constitute a means for guiding successive increments of the carrier strip 21 into engagement with a rotary member 28 which serves to apply successive uniting bands 17 of a predetermined number of uniting bands to one side of the leader of the fresh web 9 in such a way that the file of applied uniting bands 17 forms at the one side of the leader of the fresh web 9 a row extending transversely of the direction of advancement of the webs 8, 9 from their respective bobbins 6 and 7o The arrow 24 indicates in FIG. 2 the direction of rotation of the takeup reel 19 when the reel 19 is to draw successive increments of the carrier strip 21 from the supply reel 18 and along the pulleys (including the pulleys 26) which determine the path for the strip 21 between the reels 18 and 19. As mentioned above and as can be seen in FIG. 2, a portion of such path extends around the rotary member 28 on the carriage 27. The member 28 engages successive increments of that side of the carrier strip 21 which does not carry uniting bands 17.

The carriage 27 is movable back and forth along a preferably straight path which extends transversely of the path for the expiring web 8 and the leader of the fresh web 9. One end position (namely the starting position) of the carriage 27 is shown in FIG. 2 by solid lines, and the other end position of the carriage 27 is indicated in FIG. 2 by broken lines. The extent of movability of the carriage 27 between its starting and second positions is selected by a preferably adjustable stop 31 which is adjacent the leader of the fresh web 9.

When the carriage 27 of FIG. 2 assumes its (solid-line) starting position, it maintains the pulleys 26 in an optimum position relative to an arresting device 29 for the drive 23. The illustrated arresting device is a detector (e.g., a photoelectronic detector of any known design) which serves to detect the leader of the foremost uniting band 17 on the carrier strip 21. The drive 23 can be arrested in immediate response to, or with a preselected delay following, detection of the leader or front edge of the foremost uniting band 17 adhering to that side of the carrier strip 21 which is not engaged by the peripheral surface of the rotary member 28.

Figure 3:
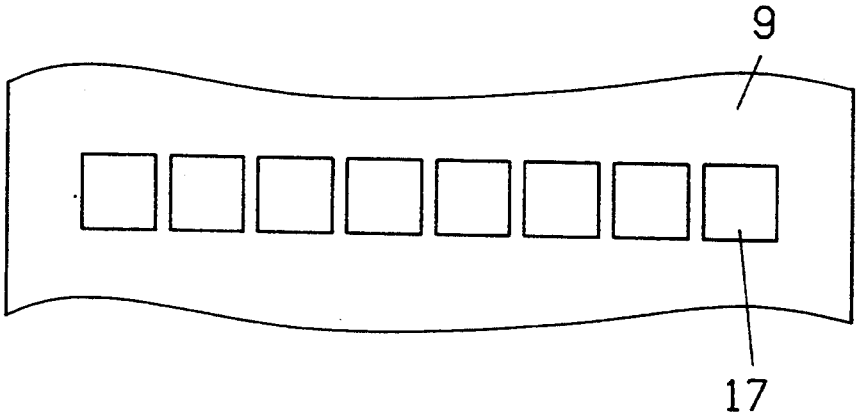
FIG. 3 is a greatly enlarged fragmentary view of the carrier of uniting bands, substantially as seen in the direction of arrow B in FIG. 2.

The purpose of the adjustable stop 31 is to determine the number of adhesive-coated uniting bands 17 which are to be transferred transversely of the leader of the fresh web 9. The number of uniting bands 17 which are to form a row of uniting bands all the way between the marginal portions of the leader of the expiring web 9 will depend on the dimensions of the uniting bands 17 and/or on the actual width of the web 8 and/or 9. Thus, and as can be seen in FIG. 3, the ends of the row of uniting bands 17 which have been transferred (by the rotary member 28) from the carrier strip 21 to the leader of the web 9 can extend at least close to both marginal portions of the web 9.

FIG. 2 further shows a pivotable or fixedly mounted plate-like back support 32 for that side of the leader of the fresh web 9 which faces away from the side carrying the row of transferred uniting bands 17. The back support 32 serves as a means for properly locating the leader of the web 9 during transfer of a selected number of uniting bands 17 thereto.

The operation of the splicing apparatus 12 is as follows:

FIG. 2 shows the carriage 27 in the starting position at one end of a straight path extending transversely of the adjacent portion of the path for the expiring web 8 and for the leader of the fresh web 9. The leader of the fresh web 9 has a foremost or forward portion which is adjacent the path of the carriage 27 between the solid-line and broken-line positions of FIG. 2. The expiring web 8 is assumed to be drawn by a pulley of the magazine 11 or by other means so that it advances at a normal speed along its path from the bobbin 6, between the pressing members 13, 14 (which are maintained in the retracted positions of FIG. 1) and through the magazine 11 on its way to a packing, wrapping or other station.

If it is desired or necessary to splice the leader of the fresh web 9 to the adjacent (e.g., trailing) portion of the expiring web 8, the prime mover 23 is started to rotate the takeup reel 19 in the direction of arrow 24 until the monitoring device 29 detects the leader of the foremost uniting band 17 on the carrier strip 21 while the carriage 27 is maintained in the starting position (shown in FIG. 2 by solid lines). Furthermore, the back support 32 is pivoted or otherwise moved to the position of FIG. 2, namely behind the leader of the fresh web 9 and adjacent that side of such leader which is not intended to carry a row of uniting bands 17.

The prime mover 23 for the takeup reel 19 is arrested in response to the signal from the monitoring device 29, i.e., when the foremost uniting band 17 is in an optimum position for transfer onto that side of the leader of the fresh web 9 which faces away from the back support 32. When the prime mover 23 is arrested, the carriage 27 is caused to move from the starting position toward the broken-line (second) position of FIG. 2. The belt transmission 22 is disengaged from the prime mover 23 or the core of the supply reel 18 is disengaged from the belt transmission 22 not later than when the carriage 27 begins to move away from the solid-line position of FIG. 2. Thus, the pulleys 26 on the carriage 27 can draw a certain length of the carrier strip 21 (with equidistant uniting bands 17 thereon) from the supply reel 18 and such uniting bands 17 are caused to adhere to the adjacent side of the leader of the fresh web 9 opposite the back support 32. The rotary member 28 then performs the function of detaching successive uniting bands 17 from (i.e., of peeling such uniting bands off) the adjacent length of the carrier strip 21, and the thus detached uniting bands are caused to adhere to the leader of the fresh web 9 to form thereon a row (as shown in FIG. 3) extending transversely of the leader of the web 9. As can be seen in FIGS. 2 and 3, the rotary member 28 can begin to apply a row of discrete uniting bands 17 adjacent one marginal portion of the fresh web 9, and the last uniting band of such row is applied to the web 9 adjacent the other marginal portion when the carriage 27 reaches and is arrested by the adjustable stop 31 when it assumes the second end position.

Peeling of successive uniting bands 17 of the row shown in FIG. 3 can begin upstream of the rotary member 28 (as seen in the direction of advancement of the carrier strip 21 from the supply reel 18 toward the takeup reel 19) because the pulleys of the guide means 26 have diameters which are sufficiently small to cause adequate flexing of successive increments of the carrier strip 21 on their way toward and along the rotary member 28. The latter then completes the detachment of a selected number of uniting bands 17 from the carrier strip 21 and cooperates with the back support 32 to ensure reliable application of each uniting band of a selected number of successive uniting bands to the leader of the fresh web 9. The number of uniting bands 17 to be transferred onto the leader of a fresh web 8 will depend on the dimensions of the uniting bands 17 and/or upon the width of the web 8 and/or 9.

When the transfer of a selected number of uniting bands 17 from the carrier strip 21 onto the leader of the web 9 is completed, the carriage 27 is moved back to its starting position (i.e., away from the adjustable stop 31). Furthermore, the prime mover 23 is then operatively connected with the supply reel 18 to drive the latter (by way of the belt transmission 22) in a counterclockwise direction (as viewed in FIG. 2) so that the strip portion which was relieved of a predetermined number of uniting bands is collected by the supply reel 18. A further splicing operation can begin when the supply of web 9 on the bobbin 7 is nearly exhausted and the trailing end of such web must be spliced to the leader of a fresh web (not shown).

The leader of the web 9, which carries a transversely extending row of uniting bands 17), is thereupon advanced by a step such as to move the row of uniting bands 17 into the clearance between the pressing members 13, 14. The web 8 is brought to a halt and at least one of the members 13, 14 is caused to move toward the other pressing member to thus establish a reliable connection between the row of uniting bands 17 on the leader of the web 9 and the adjacent trailing portion of the expiring web 8. It is customary to equip the splicing apparatus 12 with conventional means (not shown) for trimming the splice behind as well as in front of the row of uniting bands 17 between the webs 8 and 9. This is accomplished by severing the web 9 in front of the row of uniting bands 17 between the two webs and by severing the web 8 behind the splice. The support 2 is then turned through 180° so that the bobbin 7 assumes the position of the bobbin 6, the empty or nearly empty bobbin 6 is removed from the shaft 3, and a bobbin containing a fresh reel is placed onto the shaft 3. The leader of such fresh web is then moved to the position corresponding to that of the leader of the web 9 in FIG. 1. Trimming of the webs 8, 9 behind and ahead of the splice including the row of uniting bands 17 between the webs 8, 9 can take place simultaneously with movement of the pressing member 13 toward the pressing member 14 and/or vice versa.

An important advantage of the improved method and apparatus is that the relatively small uniting bands 17 can be readily manipulated with a high degree of accuracy and that such relatively small uniting bands can be used to establish a splice between two wide, medium wide or narrow webs. Moreover, the apparatus is versatile because, merely by adjusting the position of the stop 31, one can convert the apparatus from splicing wide webs to splicing of narrower webs or vice versa. Since the webs 8 and 9 are not in motion (or need not be in motion) when the pressing members 13, 14 complete the making of a splice, the thus obtained splice is highly reliable and can be provided at an accurately selected location, i.e., at a desired distance from the foremost end of the leader of the web 9 and at a desired distance from the rearmost end of the trailing portion of the web 8. Still further, and since the leader of the web 9 is at a standstill during transfer of a row containing a selected number of uniting bands 17, the bonds between such uniting bands and the leader of the web 9 are highly reliable, and such bonds are or can be enhanced during subsequent compression of the webs 8, 9 between the pressing members 13, 14. It has been found that the improved method and apparatus can be utilized for the making of highly reliable splices which can stand the tensional stresses developing when the web 8 is thereupon set in motion ahead of the splice to entrain the web 9 into the magazine 11. Individual transfer of successive uniting bands 17 from the carrier strip 21 onto the leader of the web 9 and individual pressing of successive uniting bands 17 against the leader of the web 9 also contribute to the quality of the splice. By the same token, individual detachment or peeling of successive uniting bands 17 off the carrier strip 21 for the purpose of urging the uniting bands against the adjacent side of the leader of the web 9 also contributes to higher reliability of the splice because the splice invariably contains the selected number of discrete uniting bands.

The monitoring device 29 ensures that the application of a row of uniting bands 17 to the leader of a fresh web begins at a selected distance from one marginal portion of the leader, and the adjustable stop 31 ensures that the application of the last of a selected number of successive uniting bands is completed at a selected distance from the other marginal portion of the fresh band. All this contributes to the quality of the splice.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of splicing a leader of a fresh web of flexible material to a selected portion of an expiring web of flexible material, comprising the steps of advancing the expiring web lengthwise along a predetermined path; applying an adhesive substance to one side of the leader of the fresh web; maintaining the fresh web at a standstill in the course of said applying step, advancing the leader along a portion of said path and arresting the expiring web subsequent to said applying step, pressing the applied adhesive substance at the one side of the leader of the fresh web and one side of the selected portion of the expiring web against each other and maintaining the webs at a standstill in the course of said pressing step, said applying step including attaching a series of uniting bands, which have adhesive first and second sides, to a carrier including an elongated strip of flexible material so that one side of each uniting band adheres to but is separable from the carrier, contacting the one side of the leader of the fresh web with the other sides of a selected number of uniting bands of said series, said contacting step including moving the strip transversely of the leader of the fresh web for applying the uniting bands of said selected number transversely of the leader of the fresh web and simultaneously with said contacting step detaching the one side of each of said selected number of uniting bands from the carrier.

2. A method of splicing a leader of a fresh web of flexible material to a selected portion of an expiring web of flexible material, comprising the steps of advancing the expiring web lengthwise along a predetermined path; applying an adhesive substance to one side of the leader of the fresh web; maintaining the fresh web at a standstill in the course of said applying step, advancing the leader along a portion of said path and arresting the expiring web subsequent to said applying step, pressing the applied adhesive substance at the one side of the leader of the fresh web and one side of the selected portion of the expiring web against each other and maintaining the webs at a standstill in the course of said pressing step, said applying step including attaching a series of uniting bands, which have adhesive first and second sides, to a carrier so that one side of each uniting band adheres to but is separable from the carrier, contacting the one side of the leader of the fresh web with the other sides of a selected number of uniting bands of said series including individually biasing successive uniting bands of said selected number against the one side of the leader of the fresh web, and simultaneously therewith detaching the one side of each of said selected number of uniting bands from the carrier.

3. A method of splicing a leader of a fresh web of flexible material to a selected portion of an expiring web of flexible material, comprising the steps of advancing the expiring web lengthwise along a predetermined path; applying an adhesive substance to one side of the leader of the fresh web; maintaining the fresh web at a standstill in the course of said applying step, advancing the leader along a portion of said path and arresting the expiring web subsequent to said applying step, pressing the applied adhesive substance at the one side of the leader of the fresh web and one side of the selected portion of the expiring web against each other and maintaining the webs at a standstill in the course of said pressing step, said applying step including attaching a series of uniting bands, which have adhesive first and second sides, to a carrier so that one side of each uniting band adheres to but is separable from the carrier, contacting the one side of the leader of the fresh web with the other sides of a selected number of uniting bands of said series, and detaching the one side of each of said selected number of uniting bands from the carrier including peeling successive uniting bands of said selected number off the carrier and said contacting step including individually biasing successive uniting bands of said selected number against the one side of the leader of the fresh web in the course of said peeling step.

4. Apparatus for splicing a leader of a fresh web of flexible material to a selected portion of an expiring web of flexible material with an adhesive substance, comprising means for advancing the expiring web along a predetermined path, said apparatus including a source of a flexible strip-shaped carrier of adhesive substance, said source including a supply reel and a takeup reel for said carrier and the adhesive substance including a series of discrete uniting bands having adhesive first sides separably adhering to one side of the carrier and adhesive second sides, means for locating the leader of the fresh web adjacent a predetermined portion of said path; means for applying adhesive substance to one side of the leader of the fresh web including means for transferring adhesive substance from said carrier into the one side of the leader of the fresh web, the adhesive second sides of the uniting bands adhering to the one side of the leader of the fresh web under the action of said transferring means; said transferring means including a carriage and means for moving said carriage transversely of the leader of the fresh web adjacent said locating means and means for pressing the applied adhesive substance and one side of the selected portion of the expiring web against each other.

5. The apparatus of claim 4, wherein said moving means includes means for moving carriage back and forth along a straight second path and said carriage includes means for guiding a portion of the carrier along said transferring means.

6. The apparatus of claim 5, wherein said transferring means includes a rotary member mounted on said carriage and engaging the other side of the carrier between said reels.

7. The apparatus of claim 4, further comprising means for selecting the extent of movability of the carriage along a second path transversely of said portion of said predetermined path.

8. The apparatus of claim 7, wherein said selecting means includes an adjustable stop for said carriage.

9. The apparatus of claim 8, wherein the fresh web has a predetermined width and said stop is adjustable as a function of the width of the fresh web.

10. The apparatus of claim 4, wherein said reels are rotatable in directions to draw the carrier off said supply reel and to collect the carrier on said takeup reel, and further comprising means for arresting said takeup reel when a foremost uniting band of said series assumes a predetermined position relative to said carriage while the carriage is maintained in a starting position at one side of said predetermined path.

11. The apparatus of claim 10, wherein said arresting means includes means for monitoring the one side of the carrier between said reels.

12. The apparatus of claim 4, wherein said transferring means further comprises a back support for the other side of the leader of the fresh web opposite a path for movement of the carriage transversely of the leader and of said predetermined portion of said predetermined path.

* * * * *